US008485766B2

(12) United States Patent
Hummel

(10) Patent No.: US 8,485,766 B2
(45) **Date of Patent: *Jul. 16, 2013**

(54) ROUTER LIFT ASSEMBLY WITH LIFT WHEEL

(75) Inventor: Richard M. Hummel, Parma, OH (US)

(73) Assignee: Woodpeckers, Inc., North Royalton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/599,146

(22) Filed: Aug. 30, 2012

(65) Prior Publication Data

US 2012/0328387 A1 Dec. 27, 2012

Related U.S. Application Data

(63) Continuation of application No. 12/406,550, filed on Mar. 18, 2009, now Pat. No. 8,282,323.

(51) Int. Cl.
*B27C 5/02* (2006.01)

(52) U.S. Cl.
USPC ..... 409/229; 144/135.2; 144/206

(58) Field of Classification Search
USPC ..... 409/182, 228–229, 218, 204, 206, 409/210; 144/135.2, 136.95, 154.5, 286.1, 144/286.5
IPC ..... B23C 1/20; B27C 5/02
See application file for complete search history.

(56) References Cited

U.S. PATENT DOCUMENTS

| | | | | |
|---|---|---|---|---|
| 4,537,234 | A | 8/1985 | Onsrud | |
| 4,820,089 | A | 4/1989 | Shiets | |
| 5,139,061 | A | 8/1992 | Neilson | |
| 6,318,936 | B1 | 11/2001 | McFarlin et al. | |
| 6,505,659 | B1 | 1/2003 | Hummel | |
| 6,550,154 | B1 | 4/2003 | Smith | |
| 6,725,892 | B2 | 4/2004 | McDonald et al. | |
| 6,739,066 | B2 | 5/2004 | Smith | |
| 6,792,984 | B2 | 9/2004 | Fontaine | |
| 6,863,480 | B1 | 3/2005 | Taylor | |
| 6,948,892 | B2 | 9/2005 | Hummel | |
| 6,966,122 | B2 | 11/2005 | Smith | |
| 7,108,463 | B2 | 9/2006 | Hummel | |
| 7,334,613 | B2 | 2/2008 | Griffin et al. | |
| 7,334,614 | B2 | 2/2008 | Cooper et al. | |
| 7,438,095 | B2 | 10/2008 | Hessenberger et al. | |
| 7,559,347 | B2 | 7/2009 | Hummel | |
| 8,282,323 | B2 * | 10/2012 | Hummel | 409/229 |
| 2008/0078472 | A1 | 4/2008 | Hummel | |

* cited by examiner

*Primary Examiner* — Daniel Howell
(74) *Attorney, Agent, or Firm* — Sand & Sebolt

(57) ABSTRACT

A rotary cutter lifting apparatus comprising a table plate having an opening and an upper surface, a carriage disposed beneath the table plate and adapted for supporting the rotary cutter, and an adjustment mechanism positioned entirely below the table plate upper surface and operable through the opening. A method of operating a rotary cutter lifting apparatus comprising the steps of positioning the rotary cutter lifting apparatus having a carriage and an adjustment mechanism entirely below a table plate upper surface having an opening, and operating the adjustment mechanism through the opening.

20 Claims, 16 Drawing Sheets

FIG-7
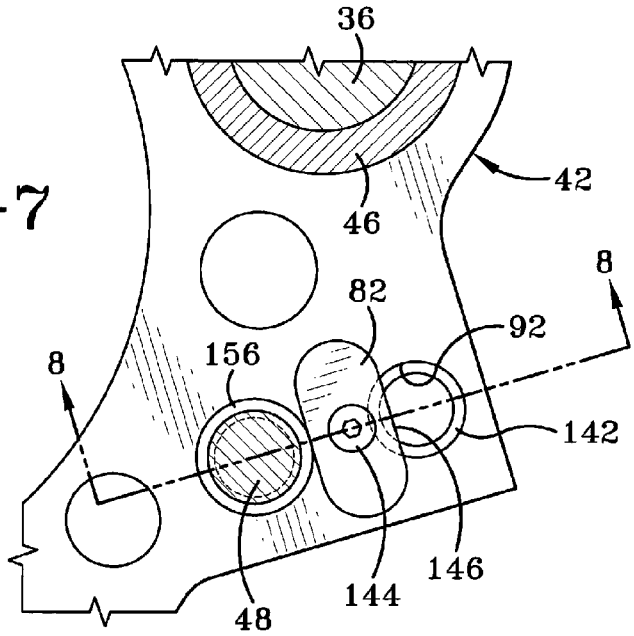
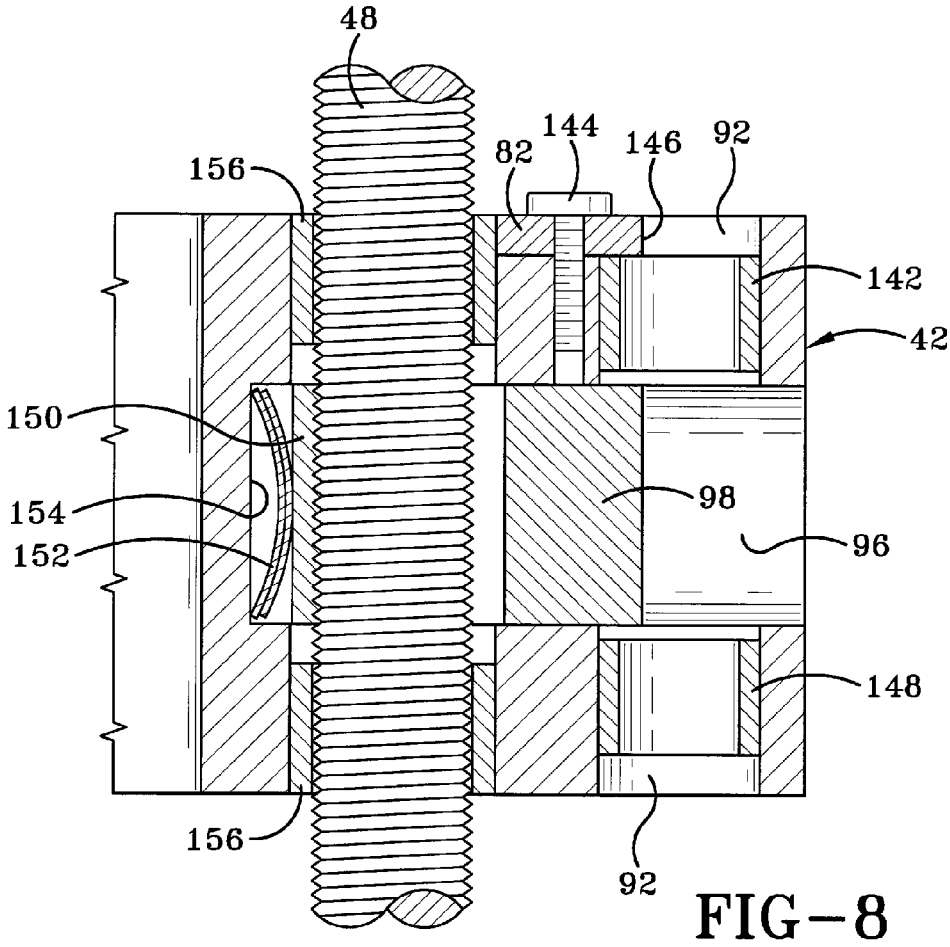
FIG-8

ROUTER LIFT ASSEMBLY WITH LIFT WHEEL

CROSS-REFERENCE TO RELATED APPLICATION

This is a Continuation of U.S. patent application Ser. No. 12/406,550 filed Mar. 18, 2009, the entire specification of which is incorporated herein by reference.

BACKGROUND OF THE INVENTION

1. Technical Field

The invention relates generally to an adjustable rotary lift assembly which is mounted to a work table. More particularly, the invention relates to an assembly for raising and lowering a router bit with both a coarse adjustment mechanism and a fine adjustment mechanism. Specifically, the invention relates to an assembly with a handle for rapidly raising and lowering the router for a course adjustment and an easily accessible fine adjustment mechanism built into the rotary lift assembly.

2. Background Information

Routers can be mounted on a table so that the rotating bit for material removal is held stationary and the work piece is moved into the bit. Since the work piece moves into the bit, the router and bit must be securely held in both the vertical and horizontal orientations. A router is generally only moved in the vertical direction because, once again, the work piece can be moved horizontally about the bit.

Movement in the vertical direction is generally accomplished with either coarse adjustment or fine adjustment. Since coarse adjustment is not as accurate, coarse adjustment is used to roughly locate the bit at the desired height. Fine adjustment is then used to precisely locate the bit at the desired height. Traditionally, fine adjustment has been accomplished by locating a tool within a fine adjustment mechanism to rotate a fine adjustment screw. A tool is necessary because the adjustment mechanism needs to be below the table surface so that the work piece can be moved about the router bit without interference. Thus, the traditional router lift assembly is plagued with needing additional tools to operate the fine adjustment mechanism which could ultimately be lost or damaged.

SUMMARY OF THE INVENTION

The present invention broadly comprises a rotary cutter lifting apparatus comprising a table plate having an opening and an upper surface, a carriage disposed beneath the table plate and adapted for supporting the rotary cutter, and an adjustment mechanism positioned entirely below the table plate upper surface and operable through the opening.

The present invention also broadly comprises a method of operating a rotary cutter lifting apparatus comprising the steps of positioning the rotary cutter lifting apparatus having a carriage and an adjustment mechanism entirely below a table plate upper surface having an opening, and operating the adjustment mechanism through the opening.

BRIEF DESCRIPTION OF THE DRAWINGS

The preferred embodiment of the invention, illustrative of the best mode in which Applicants have contemplated applying the principles of the invention, are set forth in the following description and are shown in the drawings.

FIG. 7 is an enlarged top view of the coarse adjustment mechanism of the present invention;

FIG. 8 is a sectional view of the coarse adjustment mechanism of the present invention taken generally about line 8-8 in FIG. 7;

DESCRIPTION OF THE PREFERRED EMBODIMENTS

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
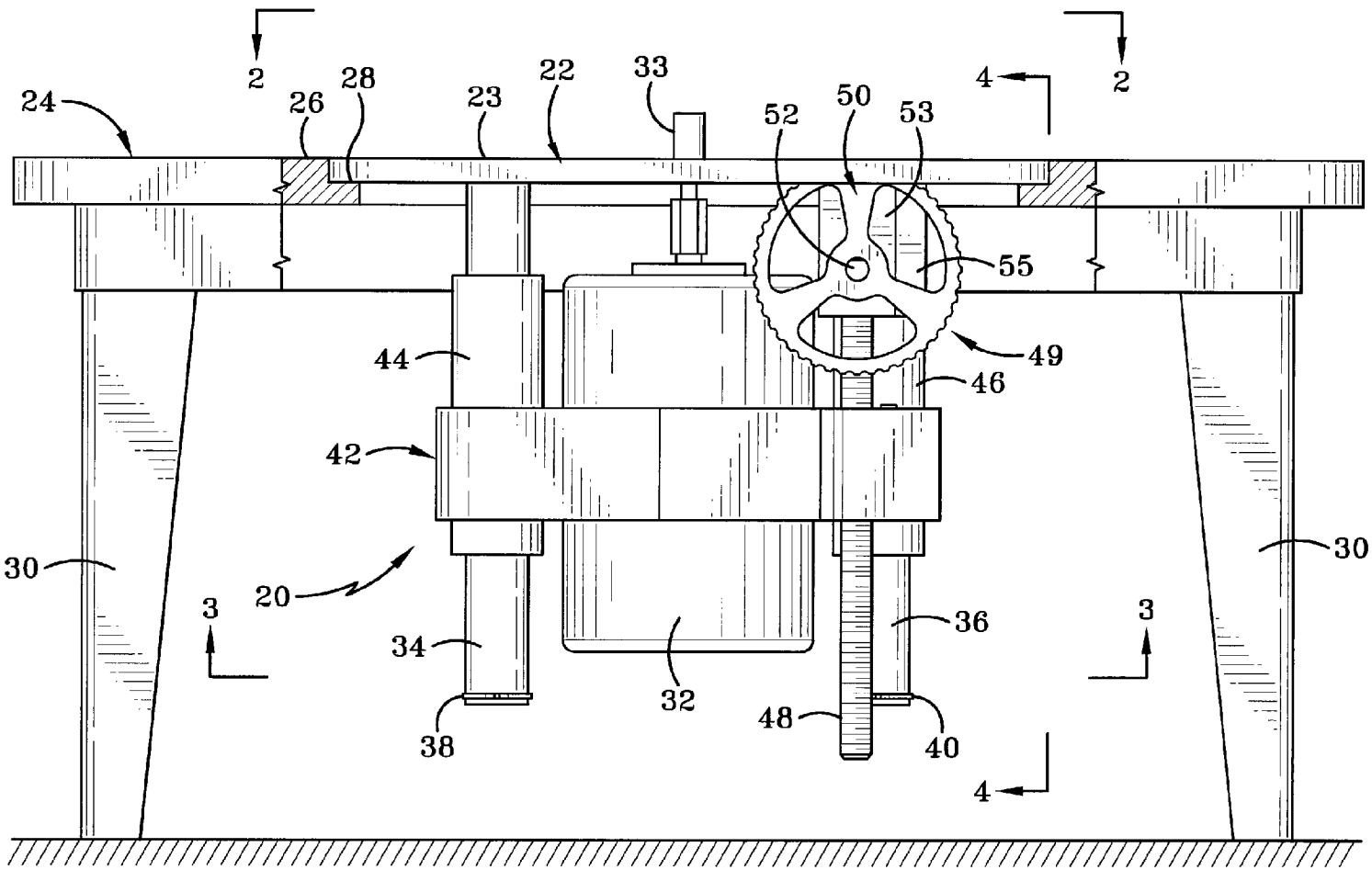
FIG. 1 is a front view of a router table with portions cut away and a router lift assembly with a lift wheel and a router mounted thereon.

The router lift assembly of the present invention is indicated generally at 20, as is particularly shown in FIGS. 1 through 18. As particularly shown in FIG. 1, a preferred embodiment lift assembly 20 includes an upper plate 22 with an upper surface 23 and is shown mounted on a work table 24 with an upper surface 26 so that upper surfaces 23 and 26 are substantially coplanar and horizontal. Work table 24 also includes a recessed ledge 28 in upper surface 26 which is approximately as deep as the thickness of upper plate 22 so that the upper surfaces form a constant and consistent work surface. Work table 24 further includes a plurality of legs 30 which function to support and raise upper surface 26 so that a router 32 may be located below upper surface 26 and allow a router bit 33 to extend above upper surface 23 as necessary.

Lift assembly 20 extends downward from upper surface 23 with a pair of guide posts 34 and 36 and stops 38 and 40 at the lower ends of the guide posts to limit the travel of the lift assembly in the downward direction. The lift assembly includes a carriage assembly 42 with bushings 44 and 46 that are slidably mounted to the pair of guide posts. Carriage assembly 42 is further connected to a coarse threaded rod 48, which is in turn connected to upper plate 22 through the coarse and fine adjustment mechanisms (described infra).

In accordance with one of the main features of the present invention, a fine adjustment mechanism 49 includes a lift wheel 50 disposed completely below upper surface 23 and the majority of upper plate 22. Lift wheel 50 slides onto a shaft 52 and both rotate together to perform fine adjustments, as detailed below. Shaft 52 extends towards and inside of an adjustment housing 53, which is enclosed on all six sides, one of which is a removable cover 55.

Figure 2:
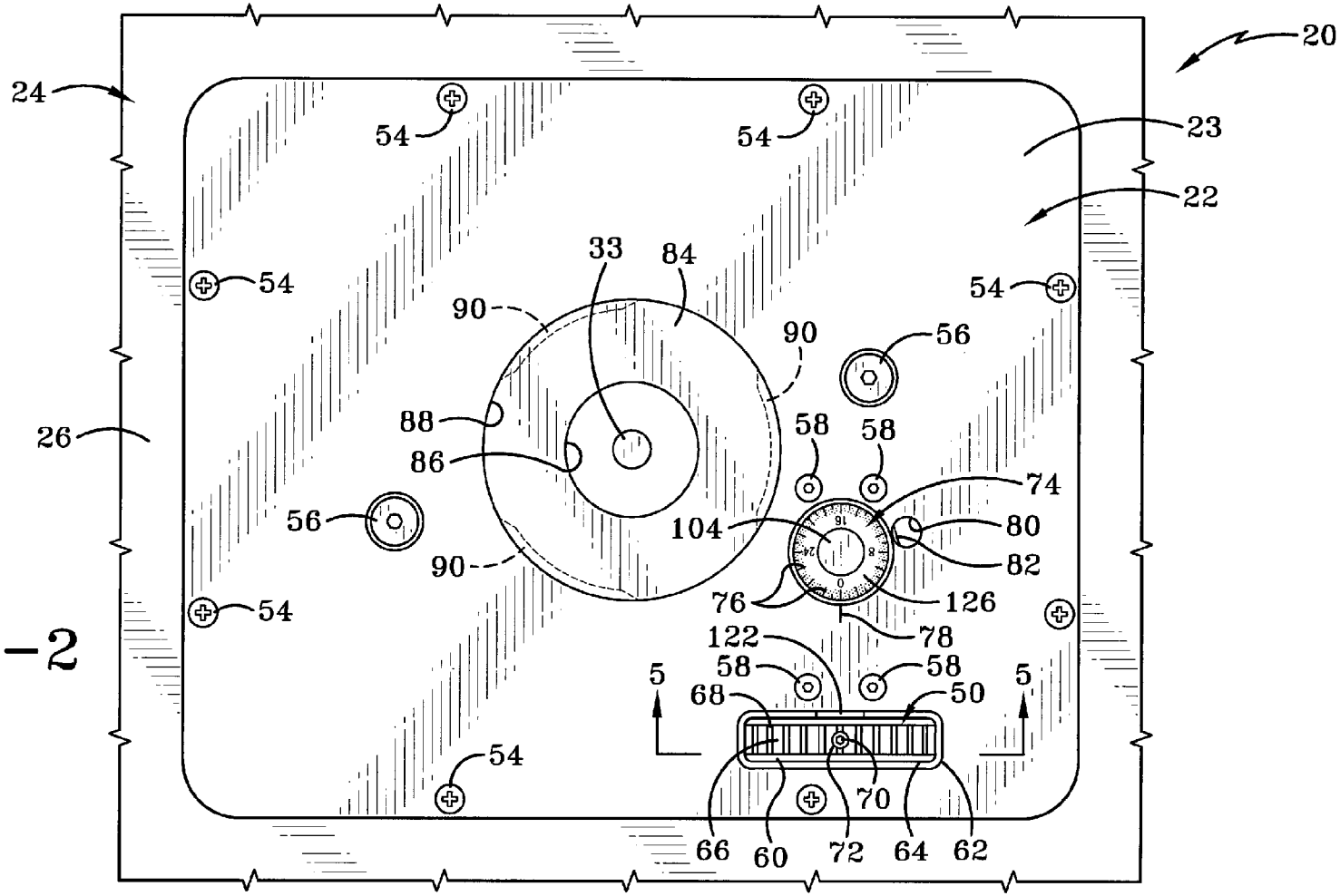
FIG. 2 is a top view of a preferred embodiment router lift assembly with a lift wheel taken generally about line 2-2 in FIG. 1.

Referring to FIG. 2, upper plate 22 is leveled relative to upper surface 26 with set screws 54. Guide posts (FIG. 1) 34 and 36 are secured to upper plate 22 with bolts 56. Adjustment housing 53 is secured along the periphery to the bottom side of the upper plate with bolts 58. Lift wheel 50 is operable from the top through a slot 60 in upper plate 22 which tapers downward from an outer surface 62 to an inner surface 64. The lift wheel includes a plurality of flats 66 and grooves 68 alternating along the outer surface to provide an improved gripping surface. Lift wheel 50 is secured to shaft 52 with a screw 70 that is inserted through a hole 72 traversing from the outer surface to the center of the lift wheel.

Fine adjustment mechanism 49 also includes a gauge 74 extending upward and terminating within upper plate 22 yet still below upper surface 23. The gauge has a plurality of dashes 76 which may correspond to the pitch of the fine adjustment screw threads or the actual height adjustment as indicated by a reference mark such as a baseline 78. Since the gauge is connected to the fine adjustment mechanism, the gauge rotates to indicate any height adjustment due to rotation of lift wheel 50. Further, gauge 74 may be arranged to rotate the fine adjustment mechanism or may be an adjustable scale which cannot rotate the fine adjustment mechanism but is rotated with the fine adjustment mechanism to indicated height adjustments as disclosed in U.S. patent application Ser. No. 11/541,761 by Hummel which is incorporated by reference herein.

Upper plate 22 also includes a coarse adjustment hole 80 that allows access to a lift-handle engaging member 82 located on the carriage assembly (FIG. 7). A router plate 84 includes a central hole 86 of a size adapted to allow router bit 33 to pass through and fits within a central hole 88 in upper plate 22. Central hole 88 in the upper plate includes ledges 90 which the router plate rests on.

Figure 3:
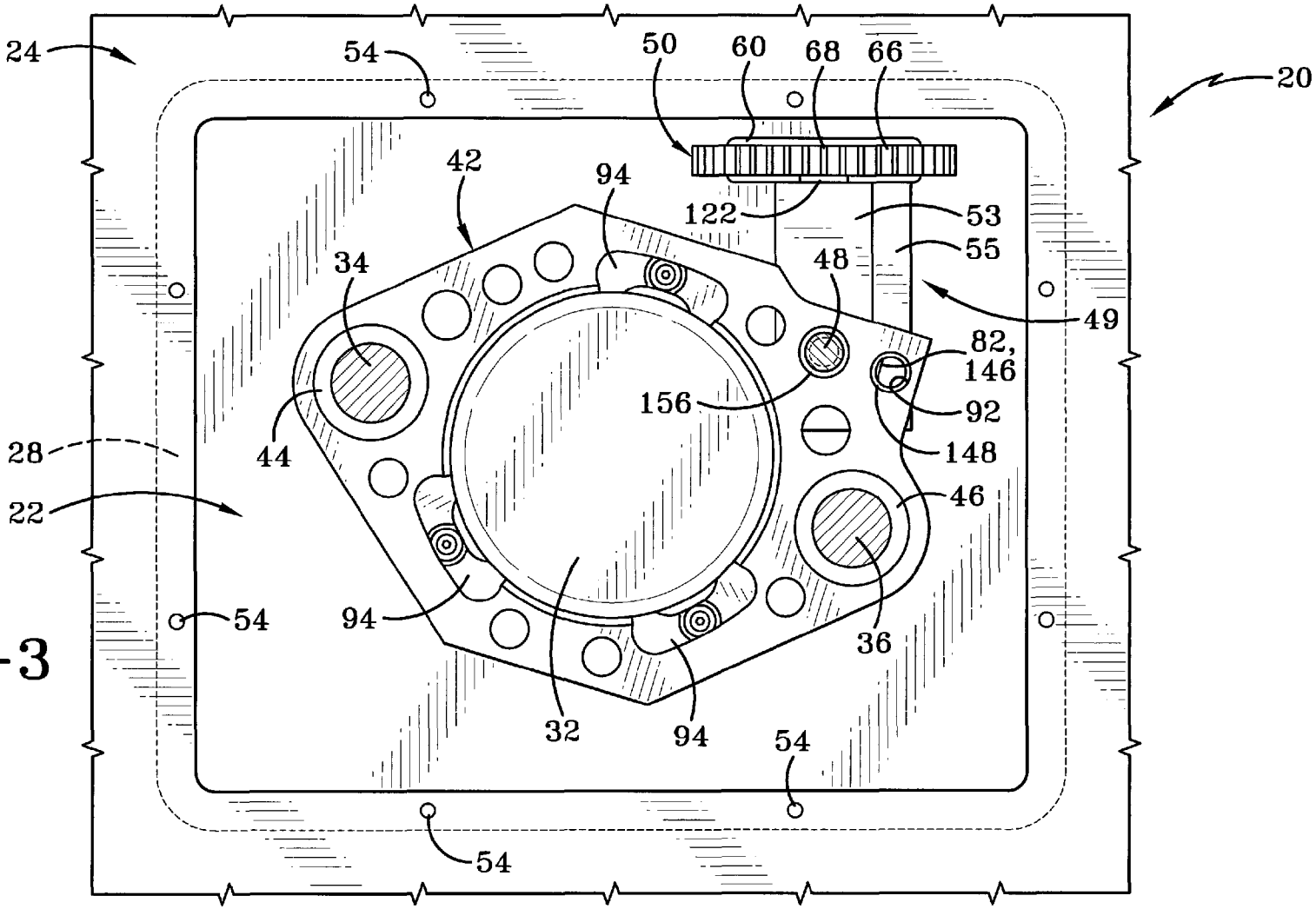
FIG. 3 is a bottom view of a preferred embodiment router lift assembly with a lift wheel taken generally about line 3-3 in FIG. 1.
Figure 4:
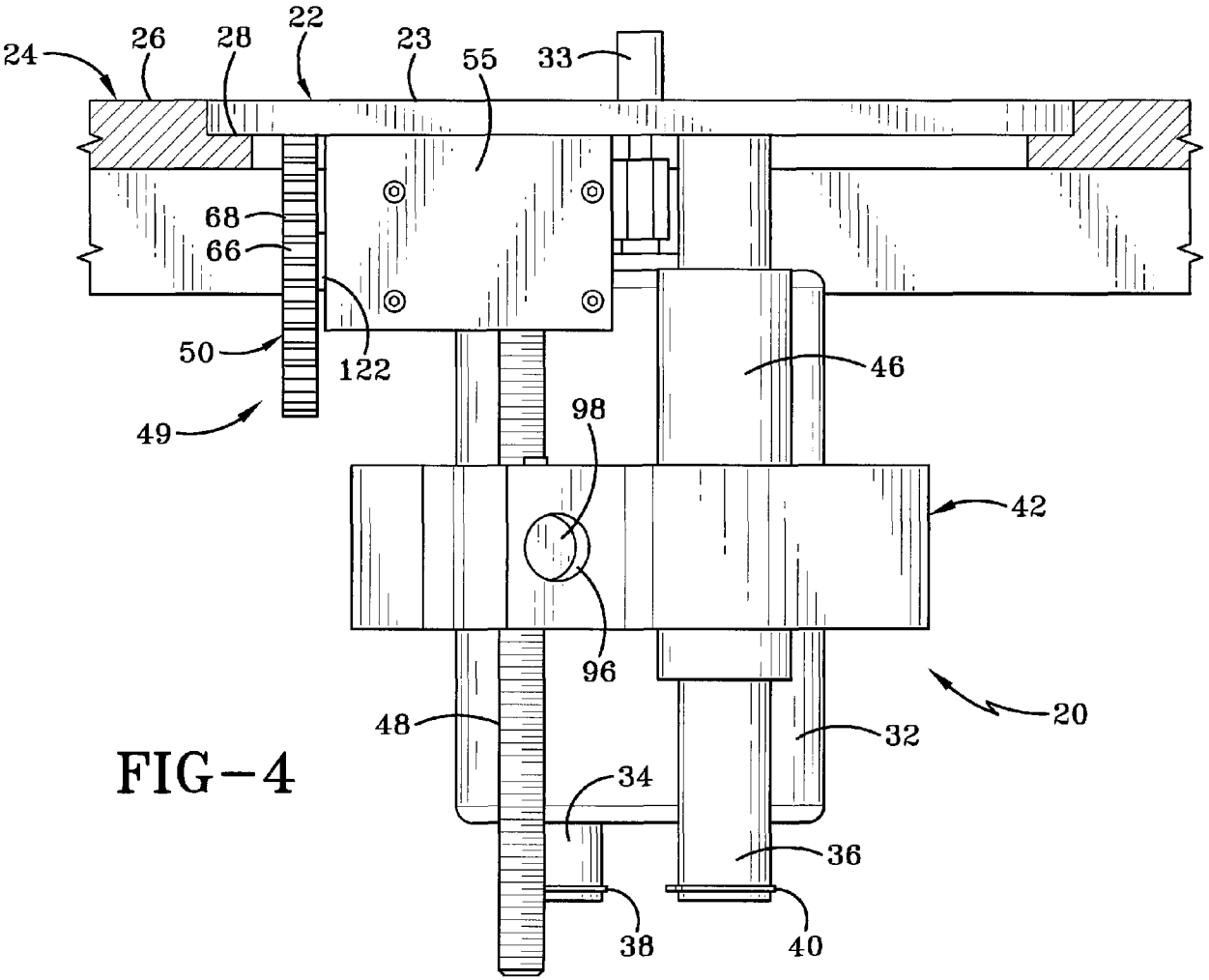
FIG. 4 is a side view of a preferred embodiment router lift assembly with a lift wheel taken generally about line 4-4 in FIG. 1.

Referring to FIGS. 3 and 4, carriage assembly 42 includes a lift-handle engaging hole 92 and a portion of lift-handle engaging member 82 visible. Further, router 32 is held in place with clamps 94. The carriage assembly also includes an aperture 96 in the side of the carriage assembly proximate and directed towards coarse threaded rod 48. A member 98 is located within the aperture to selectively engage and disengage the coarse threaded rod as seen in greater detail in FIG. 8.

Figure 5:
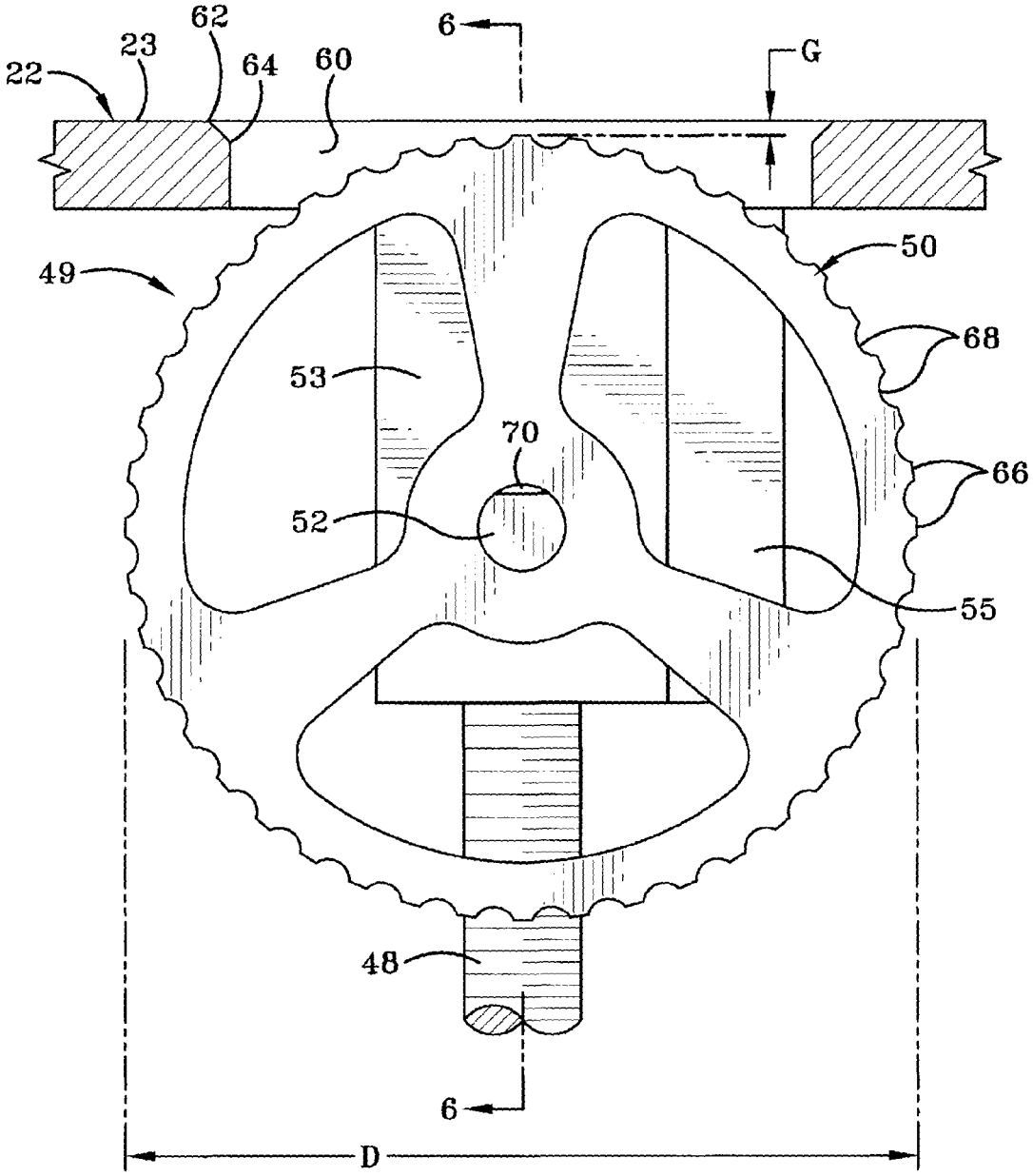
FIG. 5 is a front view of a preferred embodiment lift wheel taken generally about line 5-5 in FIG. 2.
Figure 6:
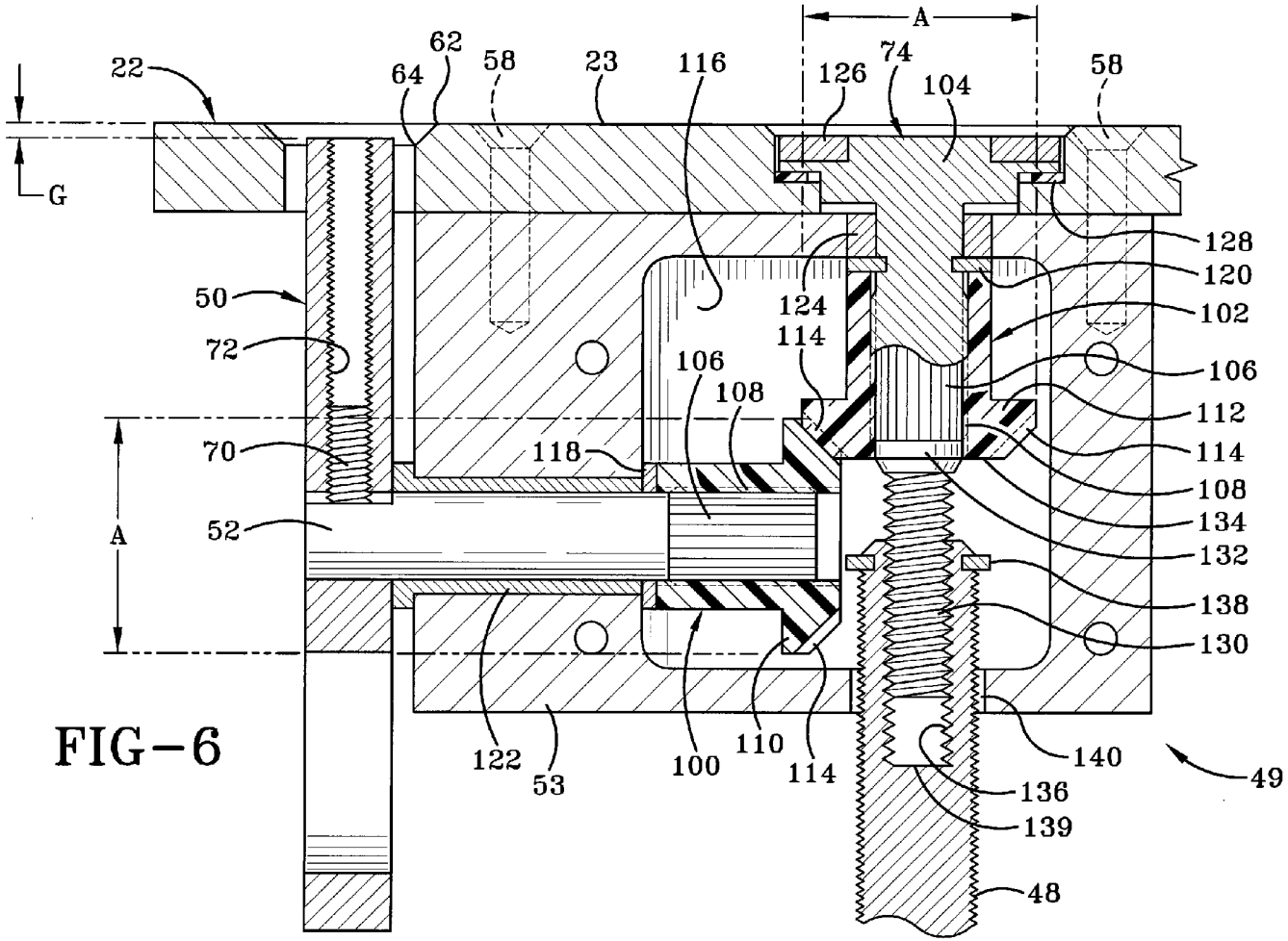
FIG. 6 is a cross-sectional view of a preferred embodiment lift wheel taken generally about line 6-6 in FIG. 5.

FIGS. 5 and 6 illustrate the details of fine adjustment mechanism 49. Lift wheel 50 has a diameter D which is larger than slot 60. In a preferred embodiment, diameter D is in the range of 2 to 5 inches and preferably 3.5 inches, although any diameter D is suitable depending upon the dimensions of upper plate 22 and the desired fine adjustment sensitivity. Further, the lift wheel is located such that the lift wheel outer surface is below outer surface 62 by a gap G. Although gap G may be any suitable distance, the gap is preferably large enough to prevent the lift wheel from interfering with router operation as well as small enough to allow the user to easily operate the lift wheel.

In accordance with another main feature of the present invention, fine adjustment mechanism 49 includes a pair of gears 100 and 102 arranged perpendicular to each other. In particular, gear 100 surrounds shaft 52 at an end opposite lift wheel 50 and gear 102 surrounds a central shaft 104 of gauge 74 at an end opposite upper surface 23. The gears are engaged to their respective shaft with the interaction of splines 106 on the shafts and splines 108 on the inside surface of each gear. Further, gears 100 and 102 each terminate in head portions 110 and 112, which again have a splined outer surface 114 for rotational engagement with each other. Gears 100 and 102 have an outside diameter A in the range of approximately 0.5 to 1.5 inches and preferably have an outside diameter of approximately 1 inch. Accordingly, the fine adjustment mechanism utilizes a ratio in the range of 1 to 1 and 1 to 5, with a preferred ratio of approximately 1 to 3. Finally, gear 100 is spaced apart, or offset, from lift wheel 50 by a distance in the range of 1.5 to 3.5 inches and preferably 2.5 inches. Although the specific dimensions and ratios listed above correspond to the preferred embodiment, one skilled in the art should immediately recognize that these dimensions are only indicative of one embodiment and that the dimensions and ratios may be varied dramatically for various embodiments without departing from the spirit and scope of the invention as claimed.

Both of gears 100 and 102 are contained completely with in a cavity 116 of adjustment housing 53. A washer 118 is located intermediate cavity 116 and gear 100 and a snap ring 120 is located intermediate cavity 116 and gear 102. In addition, each shaft (52 and 104) rotates within a bushing 122 and 124, respectively. Gauge 74 preferably includes two components which are visible to the user, shaft 104 and a ring 126 which has previously described dashes 76. Gauge 74 is spaced above bushing 124 by washer 128, which can be replaced with an o-ring or other suitable ratcheting type mechanism to allow the gauge to rotate upon movement of the fine adjustment mechanism while allowing the gauge to be rotated without any movement of the fine adjustment mechanism as described above.

In accordance with yet another main feature of the present invention, a first end of a fine adjustment threaded rod 130 is formed within a stop 132, which is in turn secured within terminating end 134 of gear 102. Since fine adjustment threaded rod 130 is fixedly secured to gear 102, the fine adjustment threaded rod rotates to the same extent terminating end 134 of gear 102 rotates. Thus, rotation of gear 102, gauge 74, and fine adjustment threaded rod 130 are equal at all times. Further, since lift wheel 50 is rotationally connected to gear 100, which is in turn rotationally connected to gear 102, the rotation in lift wheel 50 and gear 100 are equal to gear 102, gauge 74, and fine adjustment threaded rod 130 at all times.

A second end, opposite the first end, of fine adjustment threaded rod 130 is arranged to be engaged with coarse threaded rod 48. Specifically, the fine adjustment threaded rod is threaded into a threaded opening 136 in the top of coarse threaded rod 48. The threaded opening also has a bottom wall 139. A stop 138, which may be a snap-ring or similar device, is located at the upper end of coarse threaded rod 48 and extends radially outward therefrom. Stop 138 is arranged to limit the travel of the fine adjustment screw by preventing stop 138 from traveling out of cavity 116. Coarse threaded rod 48 moves through a hole 140 in the bottom of adjustment housing 53 that is large enough for the coarse threaded rod to pass through, but not stop 138. Thus, the fine adjustment mechanism travel is limited in one direction by contact between stop 138 and cavity 116 and in the opposite direction by contact between stop 132 and coarse threaded rod 48 or contact between fine adjustment threaded rod 130 and bottom wall 139.

FIGS. 7 and 8 are detailed illustrations of the coarse adjustment mechanism. Carriage assembly 42 includes lift-handle engaging hole 92 with a bushing 142 set below lift-handle engaging member 82. The engaging member is attached to the carriage assembly with a bolt 144 and an edge 146 of the engaging member is arranged to partially block hole 92. Hole 92 extends downwards past aperture 96 and includes a second bushing 148 below the aperture. The coarse adjustment mechanism essentially includes member 98 with an engagement end 150 and a spring-biased device 152 located in a cavity 154. Engagement end 150 is preferably threaded to prevent movement of the carriage assembly relative to coarse threaded rod 48, but may include any suitable connection which prevents relative movement between the rod and the engagement member. Spring-biased device 152 is preferably a pair of springs which force the engagement end of member 98 into engagement with coarse threaded rod 48 in the resting position. The coarse threaded rod also includes a pair of bushings 156, one on each side of aperture 96 which help to resist horizontal deflection of the coarse threaded rod due to the spring biased device.

Figure 9:
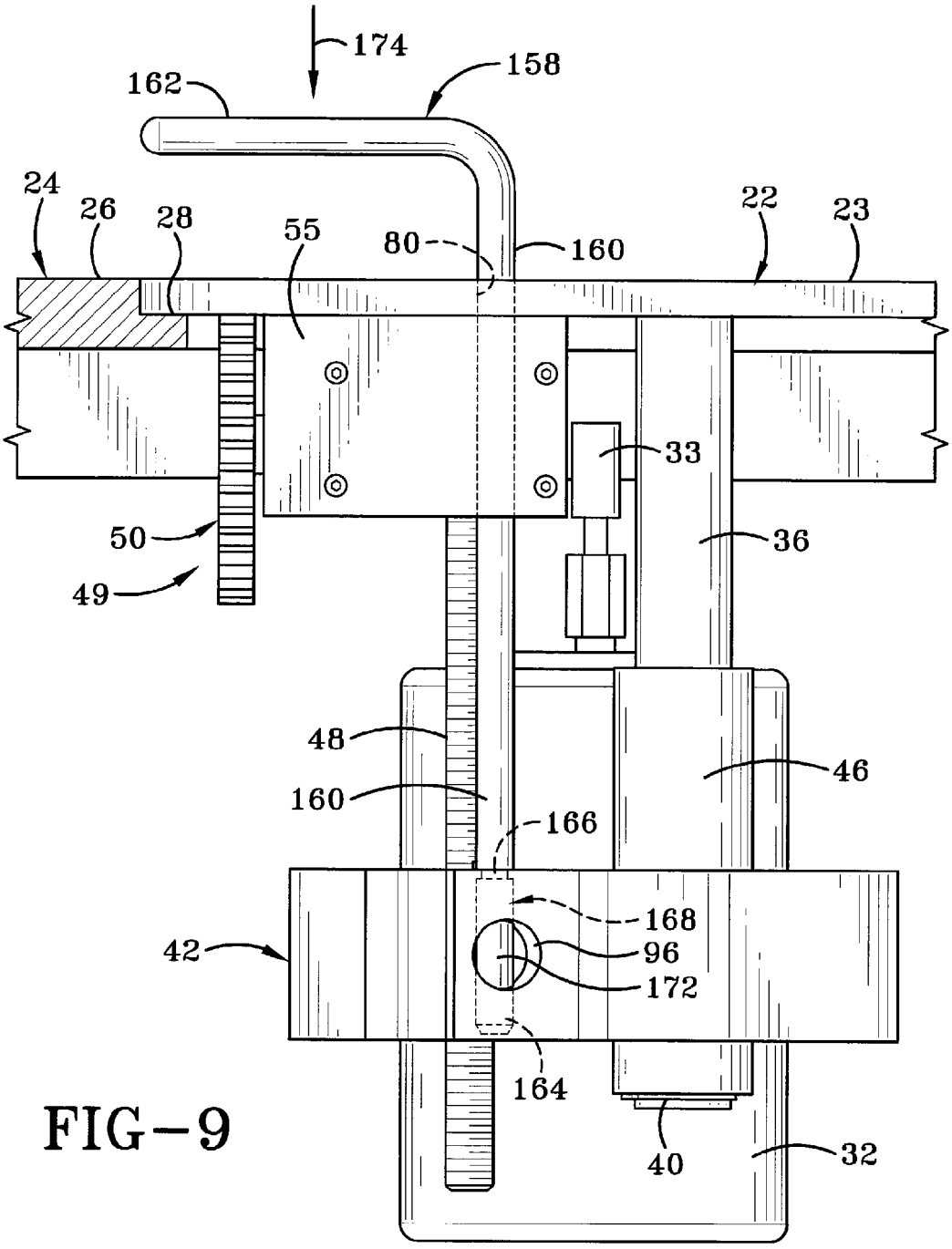
FIG. 9 is a side view of the lift wheel and coarse adjustment mechanism of the present invention with a handle being inserted into the coarse adjustment mechanism.

Referring to FIG. 9, a lift-handle 158 is preferably L-shaped with a substantially cylindrical rod 160 and a grip 162 perpendicular to the substantially cylindrical rod and located at the end opposite a lower end 164. The lower end includes a recessed portion 166 which permits the lift-handle to rotate within engaging hole 92 and is specifically located proximate lift-handle engaging member 82. The lift-handle also includes an engaging portion 168 with a flat side 170 (FIG. 11) and a rounded side 172. Since lift-handle engagement member 82 partially blocks engaging hole 92, flat side 170 must be aligned with edge 146 of the engagement member to allow the lift-handle to be inserted within engaging hole 92. Thus, the lift handle can only be inserted in one orientation (described above) until recessed portion 166 is even with edge 146 of engagement member 82.

Having described the structure of the preferred embodiment, a preferred method of operation will be described in detail and should be read in light of FIGS. 1 through 18 and particularly FIGS. 9 through 18.

FIGS. 9 through 13 illustrate the operation of the coarse adjustment mechanism to provide rapid vertical adjustment of carriage assembly 42. Lift handle 158 is inserted in the direction associated with arrow 174 through coarse adjustment hole 80 in upper plate 22 and lift-handle engaging hole 92 in carriage assembly 42. As discussed above, flat side 170 of the lift-handle must be aligned with edge 146 and recessed portion 166 is aligned with edge 146 when the lift handle is completely inserted.

Figure 11:
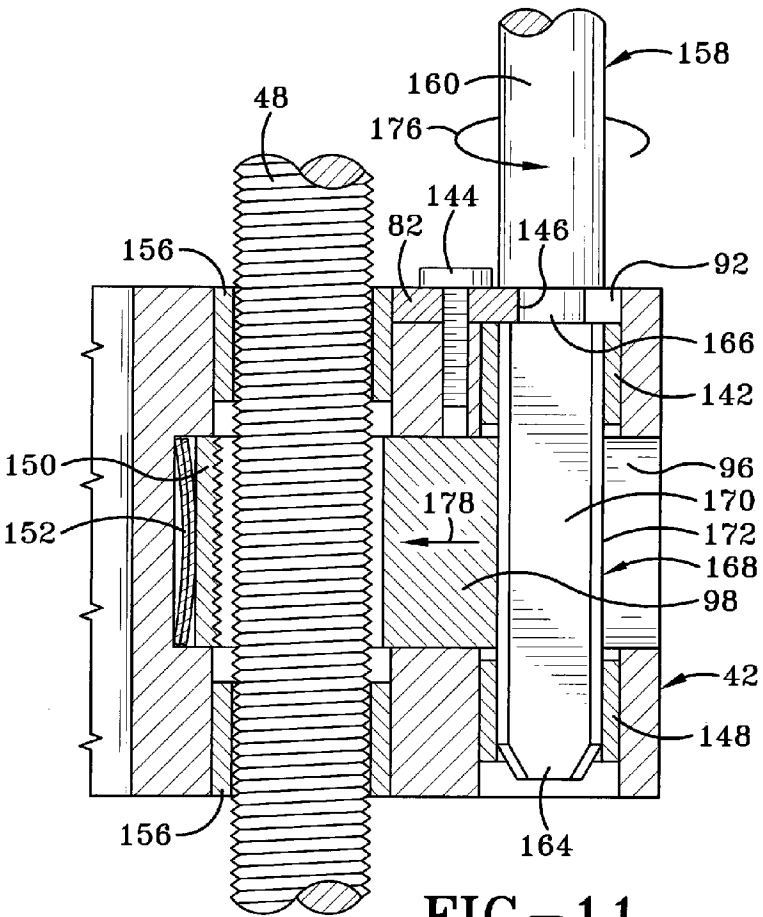
FIG. 11 is the same view as FIG. 10 with the handle being rotated to allow coarse adjustment.
Figure 10:
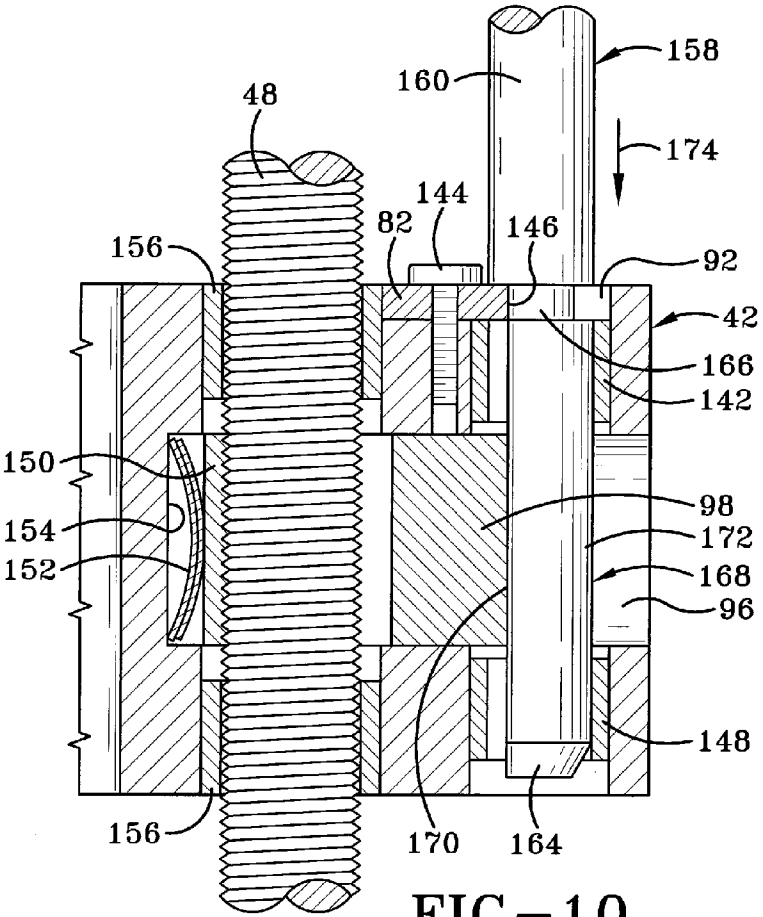
FIG. 10 is the same view as FIG. 8 with the handle inserted within the coarse adjustment mechanism.

FIG. 10 is a view of the lift handle engaging portion being inserted in the direction associated with arrow 174 within engaging hole 92, and flat side 170 aligned with edge 146 and proximate member 98. Next, FIG. 11 illustrates rotation of the lift handle in the direction associated with arrow 176. When lift handle 158 is rotated, rounded side 172 is located proximate member 98 and the increased radius of the rounded side, in comparison to the flat side, forces member 98 in the direction associated with arrow 178 which compresses spring-biased device 152 and eliminates any contact between engagement end 150 and coarse threaded rod 48. Thus, anytime that rounded side 172 is in contact with member 98, the larger radius will disengage engagement end 150 and coarse threaded rod 48 to allow for rapid vertical movement and prevent rapid vertical movement when flat side 170 is proximate member 98.

Figure 12:
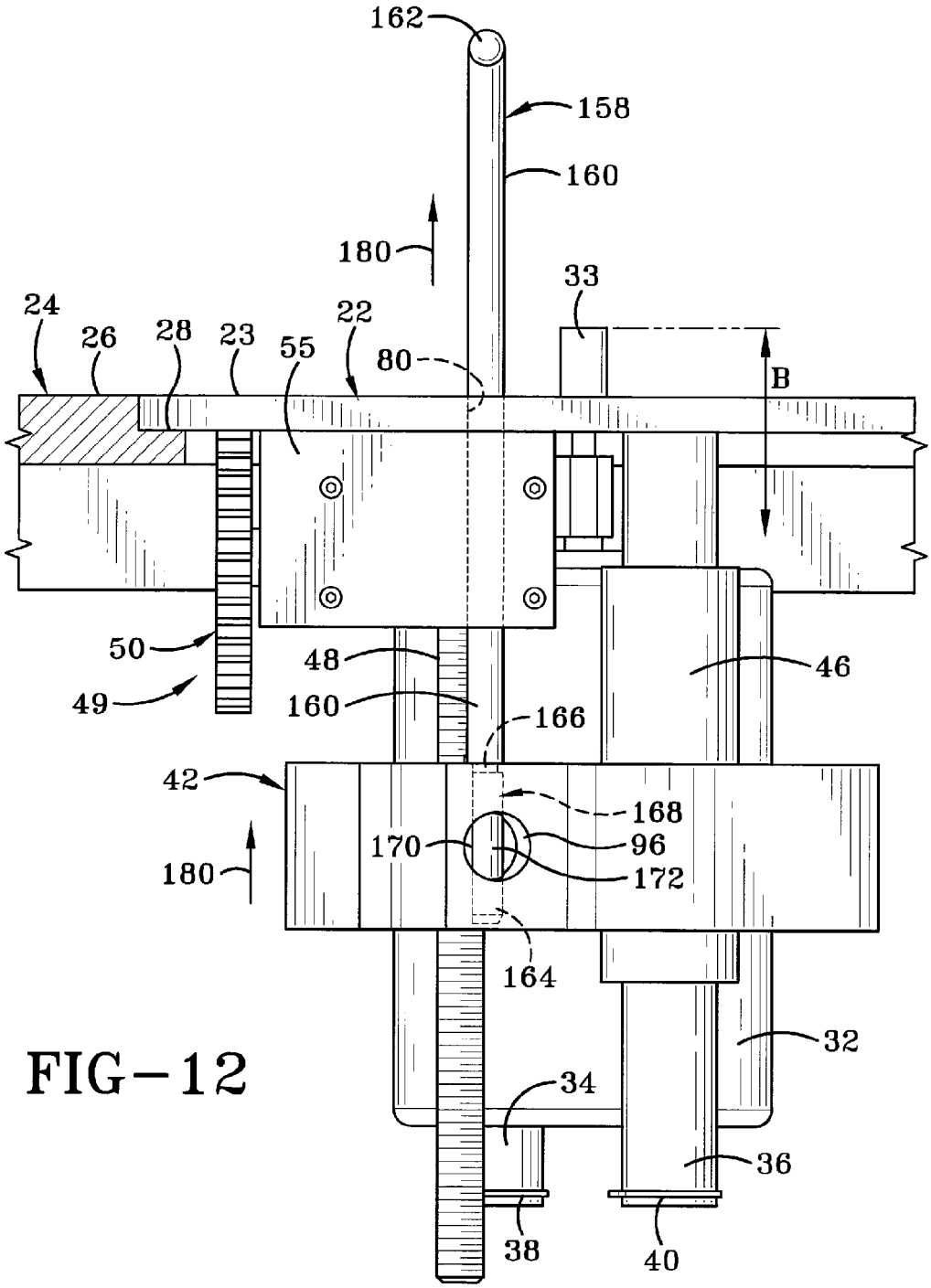
FIG. 12 is a side view of a preferred embodiment router lift assembly and the handle being adjusted upwards with the coarse adjustment mechanism.
Figure 13:
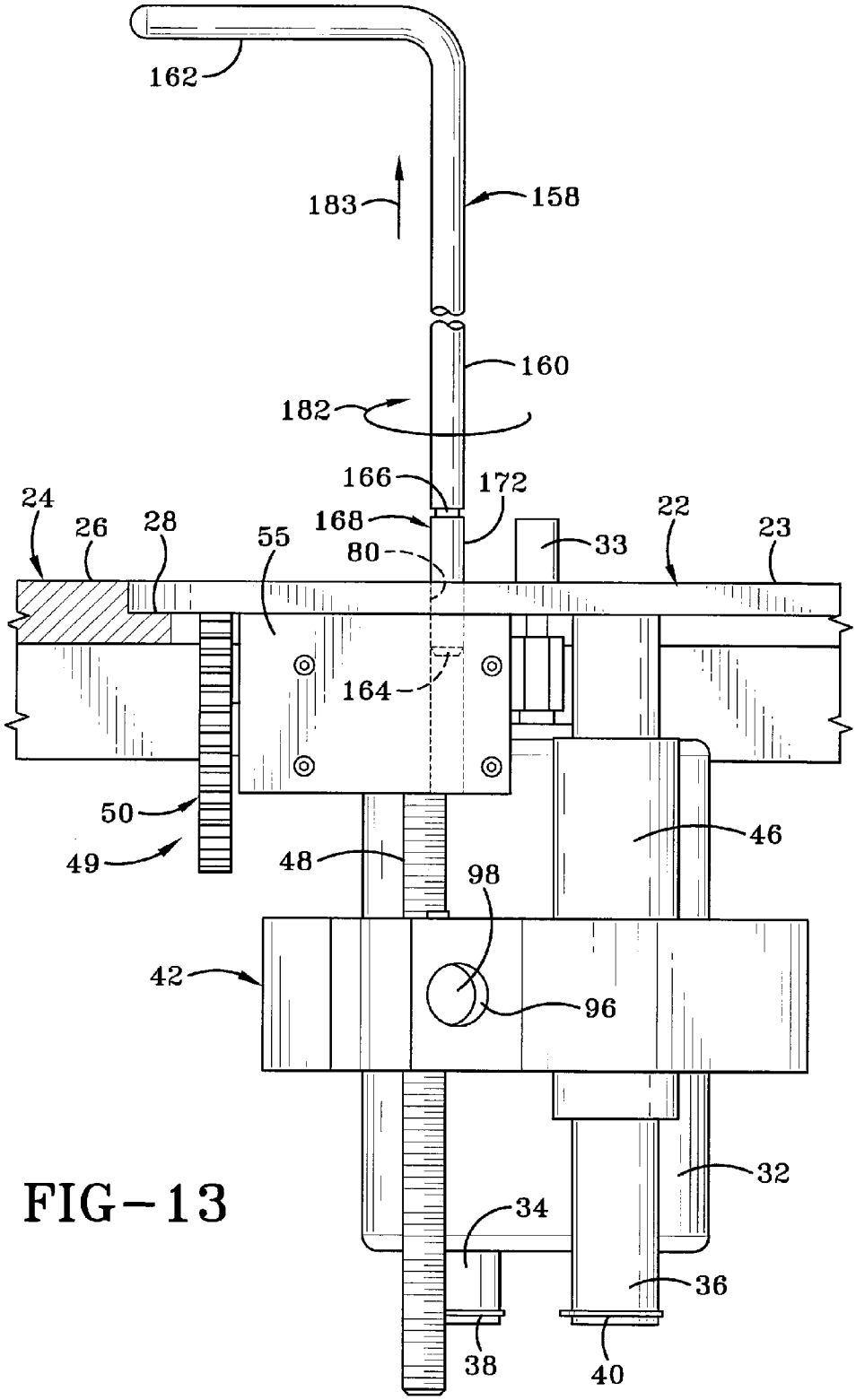
FIG. 13 is a side view of a preferred embodiment router lift assembly with the handle being rotated and removed from the coarse adjustment mechanism.

Next, FIG. 12 illustrates the rapid vertical movement. In particular, the user pulls grip 162 of handle 158 in the direction associated with arrow 180. Since, handle 158 has been rotated to allow rapid vertical movement, engaging portion 168 is located below lift-handle engaging member 82 and cylindrical rod 160 is located above the lift-handle engaging member. Further, this arrangement means that any vertical movement of the lift handle is directly imposed on the carriage assembly. Accordingly, movement of handle 158 in the direction associated with arrow 180 a distance B moves carriage assembly 42 in the direction associated with arrow 180 a distance also equal to distance B. FIG. 13 illustrates the removal of the lift handle after the rapid vertical movement is accomplished. To remove the lift handle, the user rotates the lift handle in the direction associated with arrow 182, which is opposite of the direction associated with arrow 176, until flat side 170 is located proximate member 98. The user then pulls lift handle 158 in the direction associated with arrow 183 to remove the lift handle from lift-handle engaging hole 92 and coarse adjustment hole 80.

Figure 14:
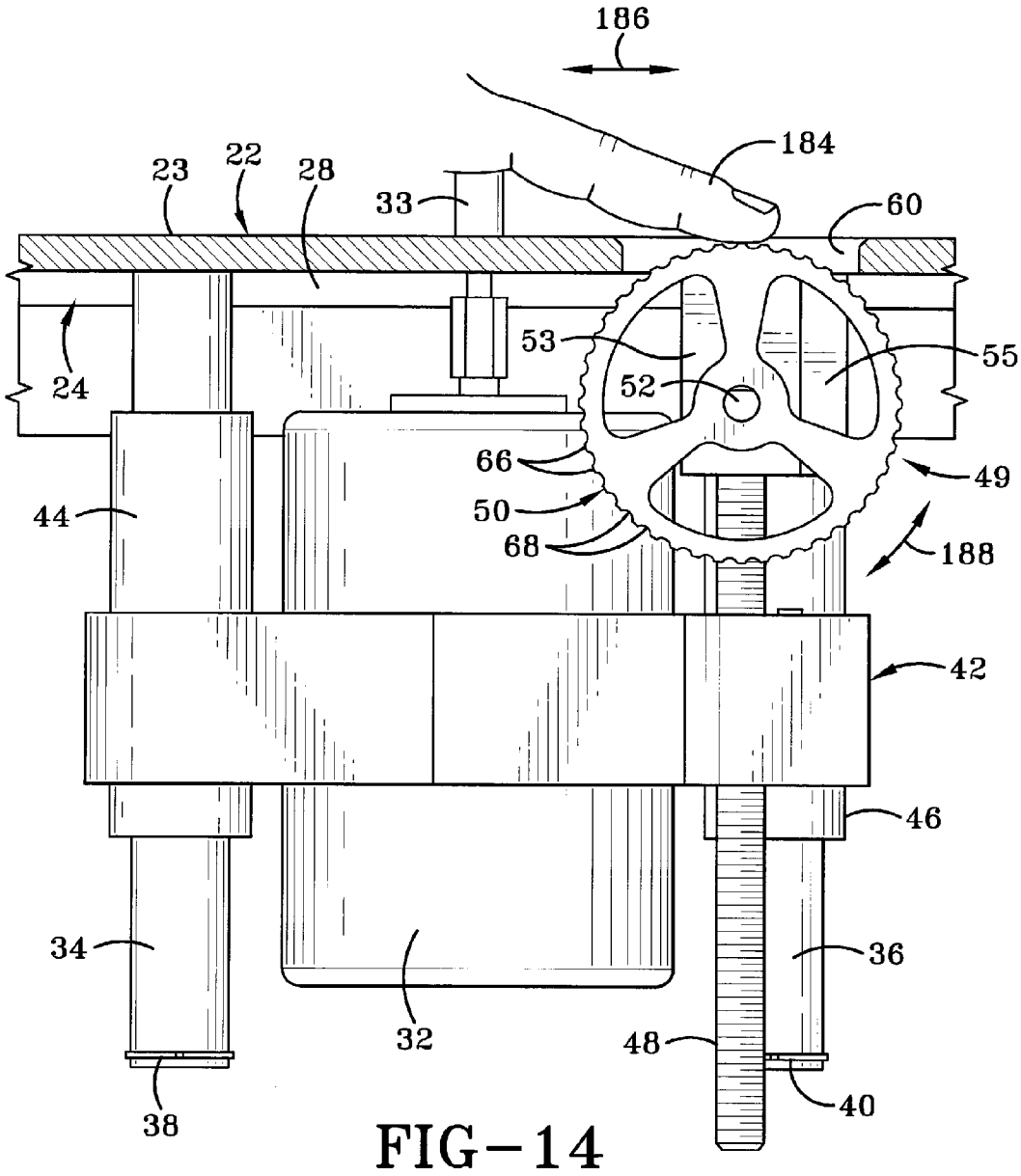
FIG. 14 is a front view of a preferred embodiment router lift assembly with a user operating the lift wheel to provide a fine adjustment and portions of the table plate removed.
Figure 15:
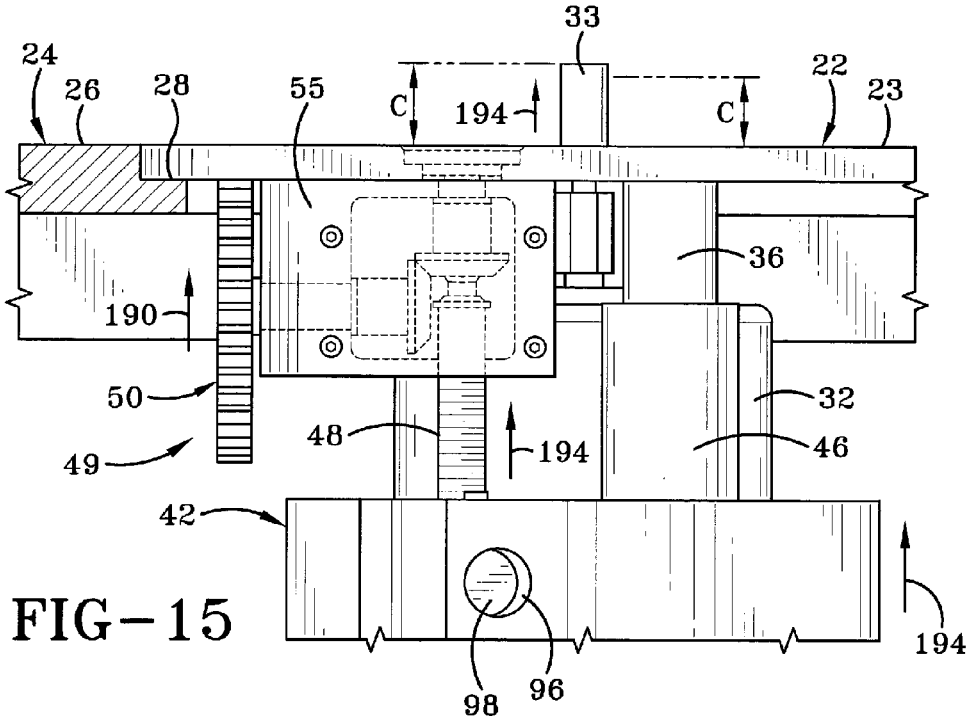
FIG. 15 is a side view of a preferred embodiment lift wheel being rotated to provide a fine adjustment upwards.
Figure 16:
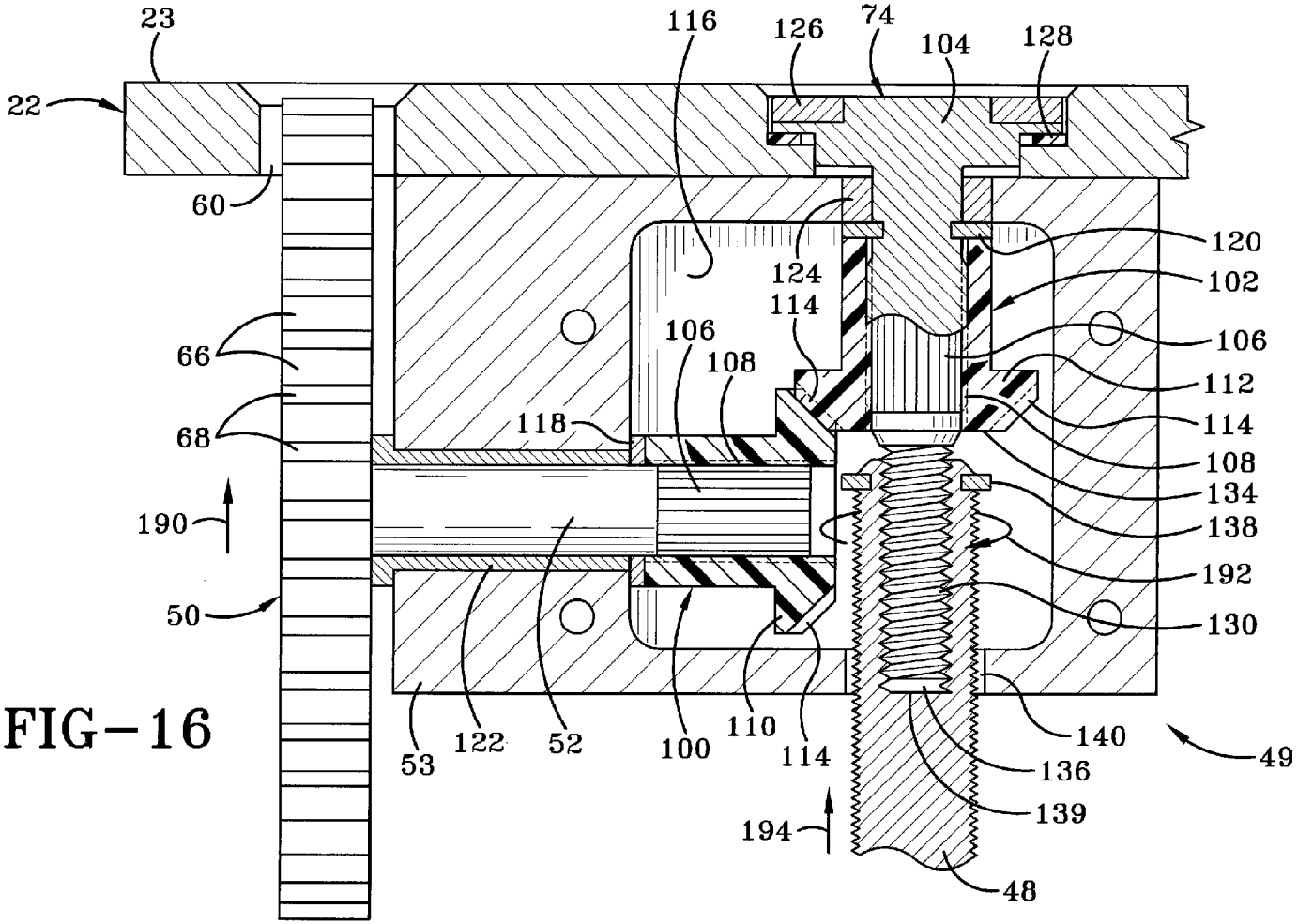
FIG. 16 is an enlarged view of the lift wheel being rotated and the fine adjustment mechanism providing a fine adjustment upwards.

FIGS. 14 through 18 illustrate the operation of the fine adjustment mechanism to provide detailed vertical adjustment of carriage assembly 42. FIG. 14 illustrates a user's finger 184 traversing slot 60 and providing a displacement in the directions associated with arrows 186. The displacement in the directions associated with arrows 186 is translated into a rotation of lift wheel 50 and shaft 52 in the directions associated with arrows 188. FIGS. 15 and 16 illustrate movement of the fine adjustment mechanism in the upwards direction. In particular, movement of lift wheel 50 in the direction associated with arrow 190 rotates shaft 52 and gear 100, which in turn rotates gear 102 and fine adjustment threaded rod 130. The rotation then imparts a perpendicular rotation of the fine adjustment threaded rod in the direction associated with arrow 192 which, being fixed in the vertical direction and threaded within the coarse threaded rod, forces coarse threaded rod 48, carriage assembly 42, router 32, and router bit 33 upwards in the direction associated with arrow 194. The vertical movement of the router bit is smaller than the rapid vertical movement of the coarse adjustment mechanism and is indicated at distance C.

Figure 17:
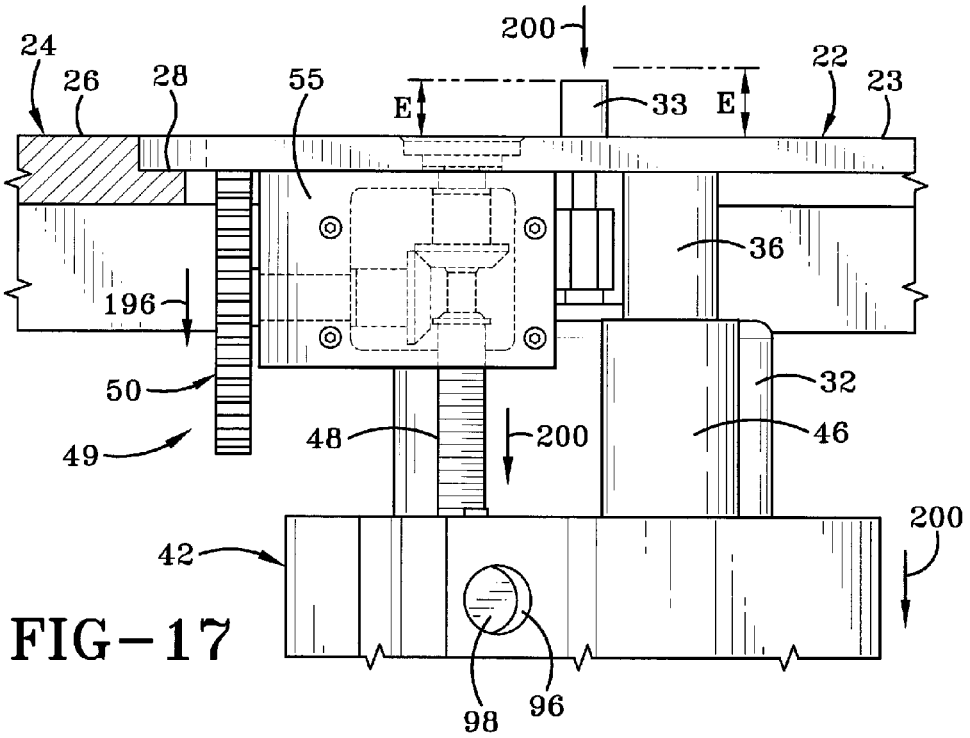
FIG. 17 is a side view of a preferred embodiment lift wheel being rotated to provide a fine adjustment downwards.
Figure 18:
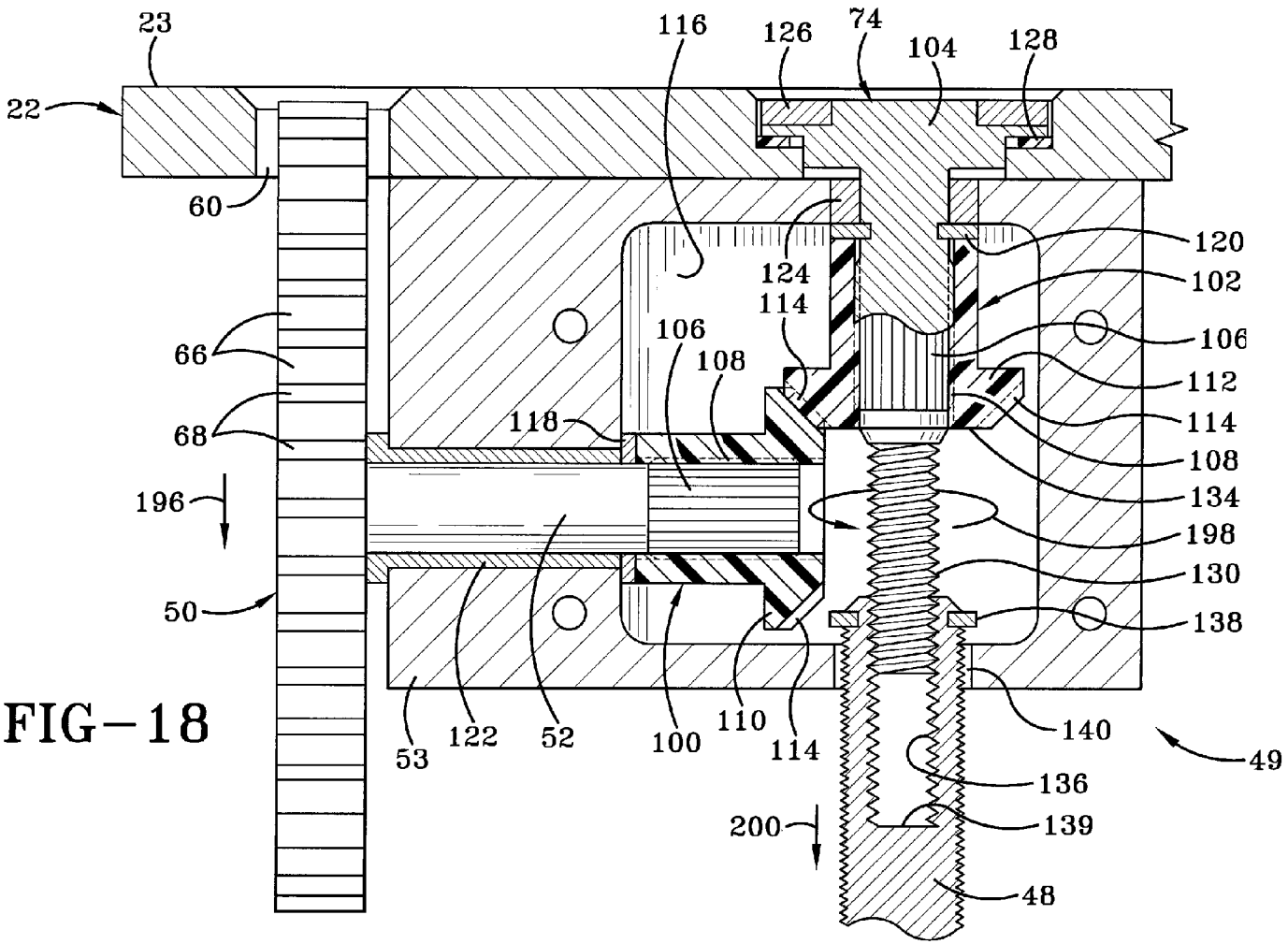
FIG. 18 is an enlarged view of the lift wheel being rotated and the fine adjustment mechanism providing a fine adjustment downwards; and, FIG. 19 is a cross-sectional view of a second embodiment coarse adjustment mechanism with annual rings instead of a continuous helical ring.

FIGS. 17 and 18 illustrate movement of the fine adjustment mechanism in the downwards direction. In particular, movement of lift wheel 50 in the direction associated with arrow 196 rotates shaft 52 and gear 100, which in turn rotates gear 102 and fine adjustment threaded rod 130. The rotation then imparts a perpendicular rotation of the fine adjustment threaded rod in the direction associated with arrow 198 (opposite the direction of arrow 192) which, being fixed in the vertical direction and threaded within the coarse threaded rod, forces coarse threaded rod 48, carriage assembly 42, router 32, and router bit 33 downwards in the direction associated with arrow 200. The vertical movement of the router bit is smaller than the rapid vertical movement of the coarse adjustment mechanism and is indicated at distance E. Accordingly, the user can operate the fine adjustment mechanism through the table plate opening free of any additional components or tools.

Having described the structure and operation of the first embodiment, only those portions of the second embodiment which are different from the first embodiment are described in detail. Likewise, similar numerals refer to similar parts throughout the various embodiments.

Figure 19:
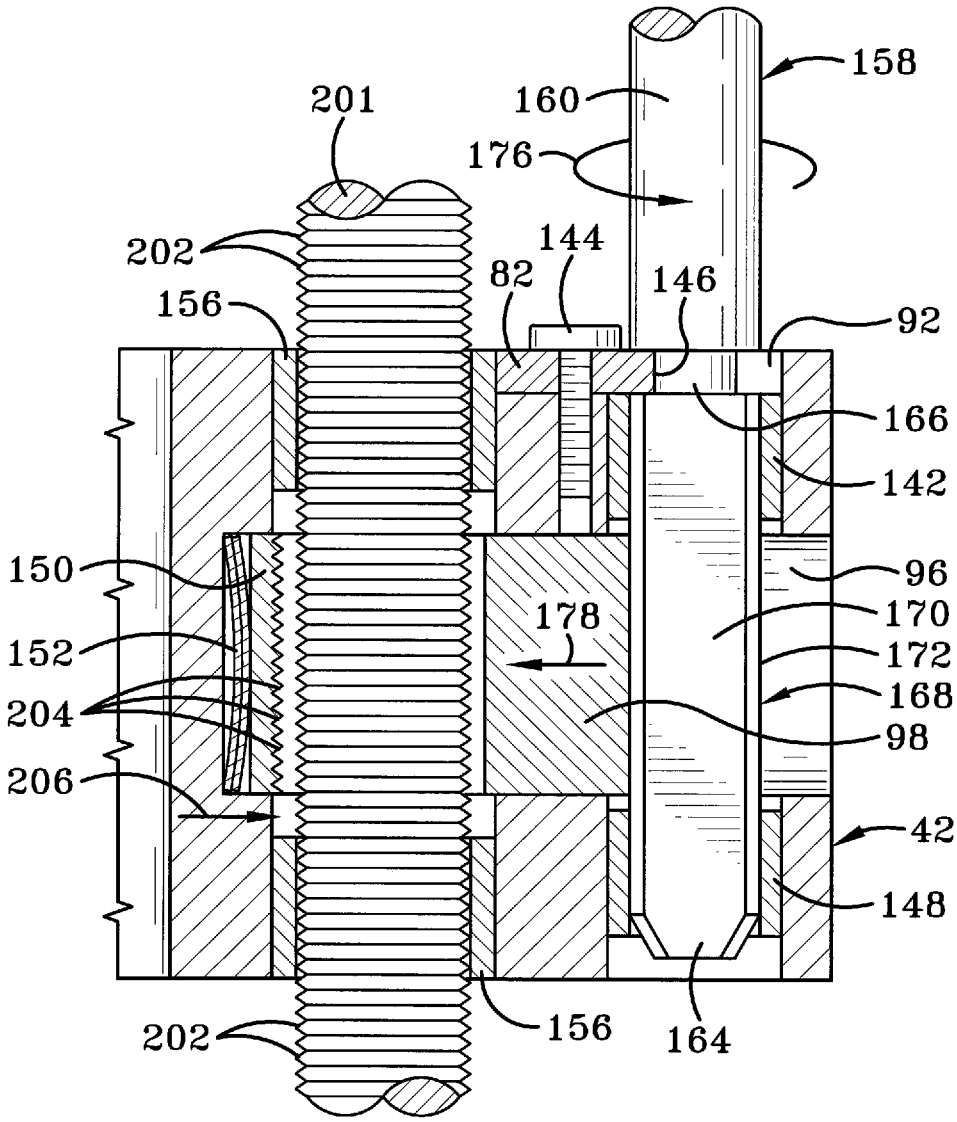

FIG. 19 illustrates a second embodiment which replaces threaded rod 48 of the first embodiment with a rod 201 having ribs 202. Ribs 202 are annular rings arranged parallel to one another along the length of the rod. Similar to the first embodiment, engagement end 150 of member 98 prevents relative movement of carriage assembly 42. However, in the second embodiment, engagement end 150 prevents relative movement of the carriage assembly by biasing teeth 204 in the direction associated with arrow 206 such that teeth are located between ribs 202. Since the teeth are located between the ribs and the teeth are vertically locked in place due to their placement within aperture 96, ribs 202 and rod 201 are also vertically locked in place. Accordingly, the ribbed rod functions identical to the threaded rod without the need for a helical thread throughout the length.

Thus, lift assembly 20 provides a mechanism for fine vertical adjustment of a rotary cutter which is also conveniently combined with a fine adjustment gauge and a coarse adjustment mechanism for rapid vertical adjustment. The fine vertical adjustment mechanism is located below upper surface 23 so that it does not interfere with cutter operation, very simple and effective and conveniently ties directly into the coarse adjustment mechanism, thereby producing a very streamlined mechanism.

It will be evident to one skilled in the art that a variety of changes can be made that are within the spirit and scope of the present invention. For instance, the fine adjustment mechanism may be configured as an independent unit for use without a coarse adjustment mechanism or configured for use with a different fine adjustment mechanism.

Accordingly, the router lift assembly is an effective, safe, inexpensive, and efficient device that achieves all the enumerated objectives of the invention, provides for eliminating difficulties encountered with prior art devices, systems, and methods, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the router lift assembly is constructed and used, the characteristics of the construction, and the advantageous new and useful results obtained; the new and useful structures, devices, elements, arrangement, parts, and combinations are set forth in the appended claims.

The invention claimed is:

1. A rotary cutter lifting apparatus comprising:

a table plate having an upper surface, a lower surface and an opening extending from the upper surface to the lower surface;

a carriage disposed beneath the table plate and adapted for supporting the rotary cutter;

an adjustment mechanism positioned entirely below the table plate upper surface and operable through the opening;

a first gear of the adjustment mechanism having a splined outer surface; and a second gear of the adjustment mechanism having a splined outer surface which rotationally engages the splined outer surface of the first gear; wherein rotation of the first gear causes rotation of the second gear; which causes vertical movement of the carriage relative to the table plate.

2. The rotary cutter lifting apparatus as defined in claim 1, wherein the adjustment mechanism includes:

a fine adjustment mechanism operable to make relatively small vertical movements in the carriage; and a coarse adjustment mechanism operable to make relatively large vertical movements in the carriage; and wherein the fine adjustment mechanism is operatively engaged with the carriage via the first and second gears.

3. The rotary cutter lifting apparatus as defined in claim 2, wherein the fine adjustment mechanism includes a lift wheel operatively engaged with the first gear; and wherein rotation of the lift wheel causes rotation of the first gear.

4. The rotary cutter lifting apparatus as defined in claim 3, further comprising a first opening defined in the table plate and extending from the upper surface to the lower surface thereof, and wherein a portion of the lift wheel is disposed within the first opening and the lift wheel is adapted to be rotated by a user's finger inserted into the first opening to engage the portion of the lift wheel.

5. The rotary cutter lifting apparatus as defined in claim 4, wherein the entire lift wheel is disposed beneath the upper surface of the table plate.

6. The rotary cutter lifting apparatus as defined in claim 5, further comprising an axle about which the lift wheel is rotatable; and wherein the axle is substantially aligned with an axis of rotation of the first gear.

7. The rotary cutter lifting apparatus as defined in claim 3, further comprising a gauge mounted on the upper surface of the table plate; and wherein the gauge is operatively engaged with the lift wheel via the first and second gears; and the gauge is adapted to display a measurement of the vertical distance of the carriage relative to the table plate.

8. The rotary cutter lifting apparatus as defined in claim 7, further comprising a shaft extending between the second gear and the gauge, and a threaded rod extending between the shaft and the carriage.

9. The rotary cutter lifting assembly as defined in claim 8, wherein rotation of the second gear causes both the shaft and the threaded rod to rotate in unison therewith.

10. The rotary cutter lifting assembly as defined in claim 8, further comprising an engagement assembly disposed intermediate the threaded rod and the carriage; wherein the engagement assembly is movable between an engaged position and a disengaged position; and when the engagement assembly is in the engaged position, the fine adjustment mechanism is operable to cause vertical movement in the carriage; and when the engagement assembly is in the disengaged position, the fine adjustment mechanism is unable to cause vertical movement in the carriage.

11. The rotary cutter lifting apparatus as defined in claim 10, wherein the coarse adjustment mechanism is operable only when the engagement assembly is in the disengaged position.

12. The rotary cutter lifting apparatus as defined in claim 1, wherein the first and second gear are disposed at right angles to each other.

13. A rotary cutter lifting apparatus comprising:

a table plate having an upper and lower surface, a first opening and a second opening defined in the table plate and extending from the upper surface to the lower surface thereof, wherein the first and second openings are spaced from each other and;

a carriage disposed beneath the table plate and adapted for supporting the rotary cutter;

an adjustment assembly positioned entirely below the upper surface of the table plate; and wherein the adjustment assembly comprises:

a first adjustment mechanism which permits fine adjustment in the vertical position of the carriage; and a second adjustment mechanism which permits coarse adjustment in the vertical position of the carriage; and wherein the first adjustment mechanism is operable through the first opening in the table plate and the second adjustment mechanism is operable through the second opening in the table plate.

14. The rotary cutter lifting apparatus as defined in claim 13, wherein the first adjustment mechanism is operable by insertion of a user's fingertip into the first opening and the second adjustment mechanism is operable through the use of an additional tool inserted through the second opening.

15. The rotary cutter lifting apparatus as defined in claim 14, further comprising a lift wheel disposed entirely beneath the upper surface of the table plate and adjacent the first opening therein; and wherein the lift wheel is adapted to be rotated by the user's fingertip inserted into the first opening.

16. The rotary cutter lifting apparatus as defined in claim 15, further comprising an axle about which the lift wheel is rotated, wherein the axle is disposed substantially parallel to the upper surface of the table plate; and the lift wheel is rotatable about the axle in either of a first direction and a second direction; and wherein rotation of the lift wheel in the first direction causes the carriage to move towards the upper surface of the table plate, and rotation in the second direction causes the carriage to move away from the upper surface of the table plate.

17. The rotary cutter lifting apparatus as defined in claim 16, further comprising a gear mechanism operatively engaged between the axle and the carriage.

18. The rotary cutter lifting apparatus as defined in claim 17, wherein the gear mechanism comprises a first gear and a second gear disposed at right angles to each other; and wherein rotation of the first gear causes subsequent rotation in the second gear.

19. The rotary cutter lifting apparatus as defined in claim 18, further comprising a gauge mounted on the upper surface of the table plate and adapted to display a measurement of the vertical distance of the carriage relative to the table plate; and wherein the axle is operatively engaged with the first gear and the gauge is operatively engaged with the second gear.

20. The rotary cutter lifting apparatus as defined in claim 13, wherein the first adjustment mechanism is disengaged prior to operating the second adjustment mechanism in order to make coarse adjustments to the vertical position of the carriage.

* * * * *